US010832850B2

(12) United States Patent
Ovando et al.

(10) Patent No.: US 10,832,850 B2
(45) Date of Patent: Nov. 10, 2020

(54) TOROIDAL HAND-HELD AUTOTRANSFORMER ASSEMBLY

(71) Applicant: Radyne Corporation, Milwaukee, WI (US)

(72) Inventors: Roberto Bernardo Benedicto Ovando, Milwaukee, WI (US); Thomas Cahill, Delafield, WI (US); Robert F. Adamczyk, New Berlin, WI (US); John Justin Mortimer, Genesee, WI (US)

(73) Assignee: Radyne Corporation, Milwaukee, WI (US)

( * ) Notice: Subject to any disclaimer, the term of this patent is extended or adjusted under 35 U.S.C. 154(b) by 337 days.

(21) Appl. No.: 16/006,370

(22) Filed: Jun. 12, 2018

(65) Prior Publication Data

US 2018/0358161 A1 Dec. 13, 2018

Related U.S. Application Data

(60) Provisional application No. 62/518,812, filed on Jun. 13, 2017.

(51) Int. Cl.

| | |
|---|---|
| ***H01F 27/16*** | (2006.01) |
| ***H01F 27/02*** | (2006.01) |
| ***H01F 27/24*** | (2006.01) |
| ***H01F 41/00*** | (2006.01) |
| ***H01F 27/29*** | (2006.01) |
| ***H01F 27/28*** | (2006.01) |
| ***H01F 30/02*** | (2006.01) |

(52) U.S. Cl.

CPC ..... *H01F 27/16* (2013.01); *H01F 27/025* (2013.01); *H01F 27/24* (2013.01); *H01F 27/2895* (2013.01); *H01F 27/29* (2013.01); *H01F 30/02* (2013.01); *H01F 41/00* (2013.01)

(58) Field of Classification Search

CPC ..... H01F 27/16; H01F 27/025; H01F 30/02

See application file for complete search history.

(56) References Cited

U.S. PATENT DOCUMENTS 3,192,733 A * 7/1965 Goetz ..... F17C 3/085 62/45.1
3,501,727 A * 3/1970 Wilhelm ..... H01F 6/06 335/300
3,692,207 A * 9/1972 Vayson de Pradenne ..... H01F 27/025 220/560.12
4,297,665 A * 10/1981 Paton ..... H01F 30/16 336/183

(Continued)

FOREIGN PATENT DOCUMENTS

JP 2009-283757 A 12/2009

*Primary Examiner* — Elvin G Enad
*Assistant Examiner* — Malcolm Barnes
(74) *Attorney, Agent, or Firm* — Philip O. Post

(57) ABSTRACT

A hand-held, water-cooled toroidal autotransformer assembly is formed from longitudinally-oriented electrically conductive radially spaced apart concentric pipes that are physically and electrically configured in series and arranged around a longitudinally-oriented toroidal magnetic core to form the windings of the autotransformer with the spaces between the longitudinally-oriented concentric pipes forming a flow path for a cooling fluid within the autotransformer.

15 Claims, 7 Drawing Sheets

(56) References Cited

U.S. PATENT DOCUMENTS

| | | | | |
|---|---|---|---|---|
| 2004/0070475 | A1* | 4/2004 | Nick | H01F 27/322<br>336/61 |
| 2005/0030028 | A1* | 2/2005 | Clarke | G01R 33/3403<br>324/318 |
| 2008/0007378 | A1 | 1/2008 | Hanser | |
| 2010/0162557 | A1* | 7/2010 | Pauley, Jr. | H01F 27/08<br>29/605 |
| 2011/0175696 | A1* | 7/2011 | Hanov | H01F 27/085<br>336/59 |
| 2012/0013427 | A1 | 1/2012 | Noda et al. | |
| 2014/0132381 | A1* | 5/2014 | Weber | H01F 27/025<br>336/60 |
| 2016/0372249 | A1* | 12/2016 | Kim | H01F 27/16 |

* cited by examiner 10
1
2
18b
18
18a
4
3

18b 4
18b
3
18
1
2
1
18a
2
18b
18a 4
3
18
1

TOROIDAL HAND-HELD AUTOTRANSFORMER ASSEMBLY

CROSS REFERENCE TO RELATED APPLICATIONS

This application claims priority to U.S. Provisional Application No. 62/518,812 filed Jun. 13, 2017, hereby incorporated by reference in its entirety.

FIELD OF THE INVENTION

The present invention relates to hand-held fluid-cooled toroidal autotransformer assemblies.

BACKGROUND OF THE INVENTION

Since its commercial development in 1885, electric transformers have been widely used for the efficient transmission, distribution and transformation of the electrical energy. In the industry, electric transformers have found a range of applications that includes voltage transformation, voltage isolation and impedance matching. After the development of electric induction heating systems in the nineteen-twenties, electric transformers have been extensively used to improve the electric power transmission from a power source to an electric induction coil that induces heat in workpieces, for example, to melt or metallurgically harden workpiece materials. Commonly, electric transformers are used as matching impedance devices in induction heating systems to enhance and increase the tuning capabilities of the induction heating power sources. In recent decades, impedance matching hand-held transformers have been developed to increase the versatility of the electric induction heating processes in automotive, aerospace and transport engineering, and other applications, for example, when used in welding applications as described, for example, in U.S. Pat. No. 4,024,370.

Hand-held transformers allow the induction heating coils to be a portable device that can be freely handled by the user to accomplish its heating process requirements, for example, in hand-held induction brazing apparatus. An electric hand-held transformer typically utilizes either round cables or cylindrical electric conductors, or both round cables and cylindrical electric conductors that are wrapped and lumped around to form a shell-core (shell type) transformer where the primary and secondary windings pass inside a steel magnetic circuit (core) which forms a shell around the windings that is referred to as the shell form magnetic core.

Common hand-held transformers are built with separate primary and secondary windings. Physically a hand-held transformer will have four separate electrical connections, two of which connections are for the primary winding termination and the other two of which connections are for the secondary winding termination. The primary and the secondary windings are not physically connected to each other and are electrically isolated from each other by the shell form magnetic core. The size of the magnetic core is determined by the magnitude of the nominal voltage and the frequency of the power source connected to the transformer as well as the number of turns in the primary winding and the magnetic properties of the material that is used to build the magnetic core. The nominal electric power capacity of a transformer depends on the maximum amount of electric current that can withstand the system without exceeding a temperature rise of 50° F. over a standard ambient temperature of 70° F. according to IEEE Standard C57.12.91-1995.

The Joule power losses in the transformer windings, as well as the eddy current losses and the hysteresis losses from the magnetic core, increase as the electrical frequency of operation of the power source increases. These power losses produce overheating and hot spots that negatively impact the performance of the hand-held transformer. To avoid damages from overheating, conventional cooling systems implement injection or immersion, or a combination of injection and immersion, of the entire hand-held transformer assembly in a convection cooling medium such as mineral oil or water.

In forced cooling systems, the cooling medium is typically supplied through the two terminals of the primary winding with a separate return cooling medium lead provided for maintaining the convection flow through the hand-held transformer. In a conventional hand-held transformer design, the cooling flow is injected inside the hand-held transformer unit detailed cooling medium distribution and uniformity of the fluid flow inside the enclosed transformer. However a cooling system design that does not take into account detailed distribution and uniformity of fluid flow inside the enclosed transformer can lead to overflow and flow leakage regions that can potentially produce hot spots that endanger the electrical insulation and the performance of the hand-held autotransformer.

The induction work coil circuit is connected at the two terminals of the secondary winding with an additional pair of cooling medium leads for the supply and return of the cooling medium through the induction work coil circuit, for example, by providing an internal cooling passage through the induction work coil circuit. The separate cooling medium return lead in the primary winding and the two cooling medium connections to the induction work coil circuit add weight and volume to a conventional hand-held transformer.

One object of the present invention is to provide a hand-held fluid-cooled toroidal autotransformer assembly with improved power performance, more efficient cooling and lighter weight than a hand-held toroidal autotransformer known in the art.

BRIEF SUMMARY OF THE INVENTION

In one aspect the present invention is a hand-held fluid cooled toroidal autotransformer and autotransformer assembly formed from a plurality of longitudinally-oriented electrically conductive radially spaced apart concentric pipes inside an autotransformer enclosure that are physically and electrically configured in series connection and arranged around a toroidal magnetic core to form the windings of the autotransformer circuit with the spaces between the longitudinally-oriented electrically conductive concentric pipes forming a serial flow path for a cooling fluid within the autotransformer enclosure. Alternatively the longitudinally-oriented electrically conductive concentric pipes can be combined with litz wire to form the autotransformer circuit.

The above and other aspects of the invention are set forth and described in the present specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims.

FIG. 2(*a*) and FIG. 2(*b*) are a side elevation view and a top plan view, respectively, of the autotransformer assembly shown in FIG. 1.

FIG. 3(*a*) and FIG. 3(*b*) are a right end elevation view and a left end elevation view, respectively, of the side elevation view of the autotransformer assembly shown in FIG. 2(*a*).

FIG. 4(*b*) is a top center cross sectional elevation view of the top plane view of the autotransformer assembly shown in FIG. 2(*b*).

FIG. 6(*b*) is a cooling fluid line flow diagram illustrating the inner to outer spiral path of cooling fluid flow in the autotransformer assembly of FIG. 6(*a*).

FIG. 7(*b*) is a cooling fluid line flow diagram illustrating the inner to outer spiral path of cooling fluid flow in the autotransformer assembly and induction load coil circuit of FIG. 7(*a*).

FIG. 8(*c*) is an electric line diagram illustrating the interconnection of the plurality of longitudinally-oriented, electrically conductive concentric pipes forming the autotransformer assembly in FIG. 8(*b*)

DETAILED DESCRIPTION OF THE INVENTION

Figures 1, 2A, 2B, 3A, 3B:
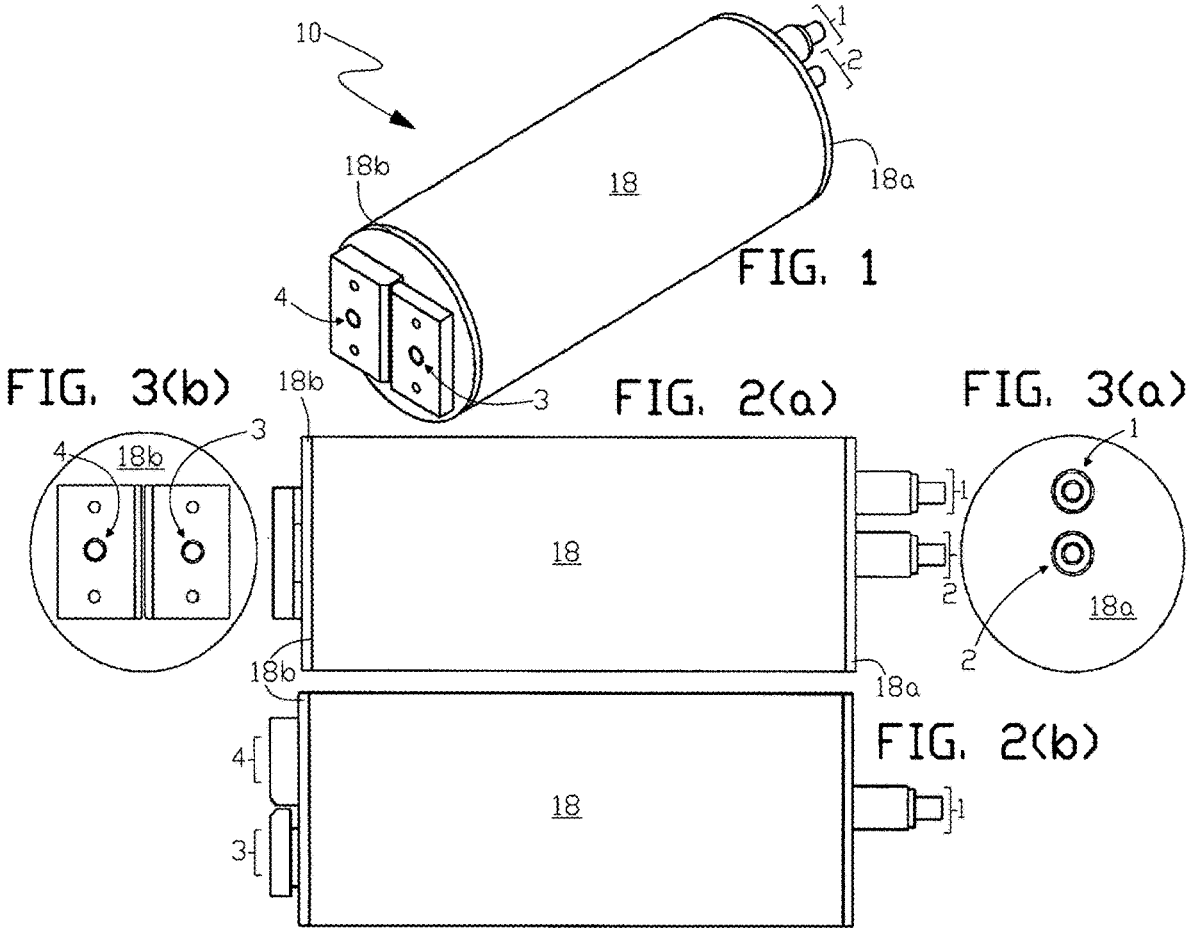
FIG. 1 is a perspective view of one example of a hand-held fluid-cooled toroidal autotransformer assembly of the present invention.
Figure 4A:
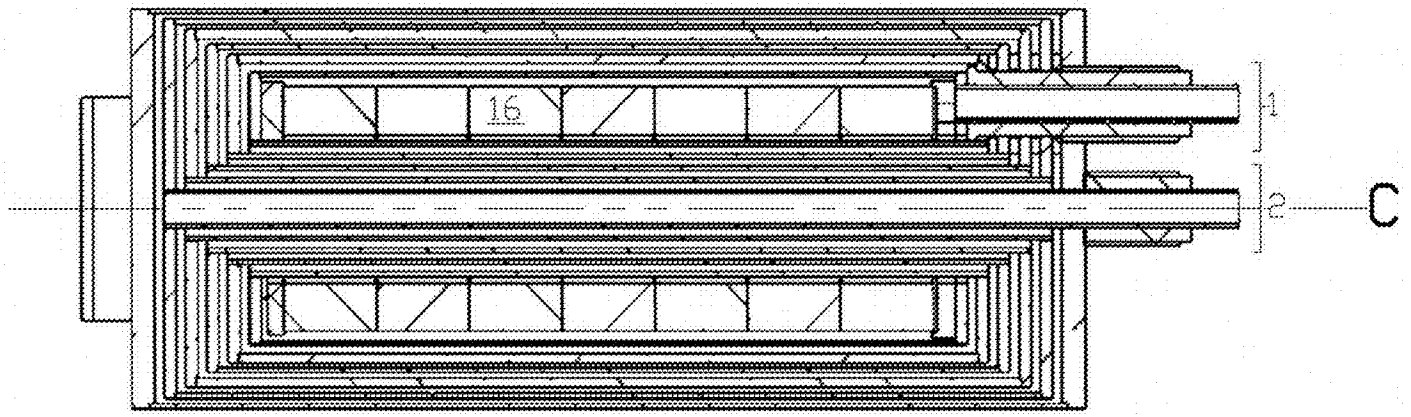
FIG. 4(*a*) is a side center cross sectional elevation view of the side elevation view of the autotransformer assembly shown in FIG. 2(*a*).
Figure 4B:
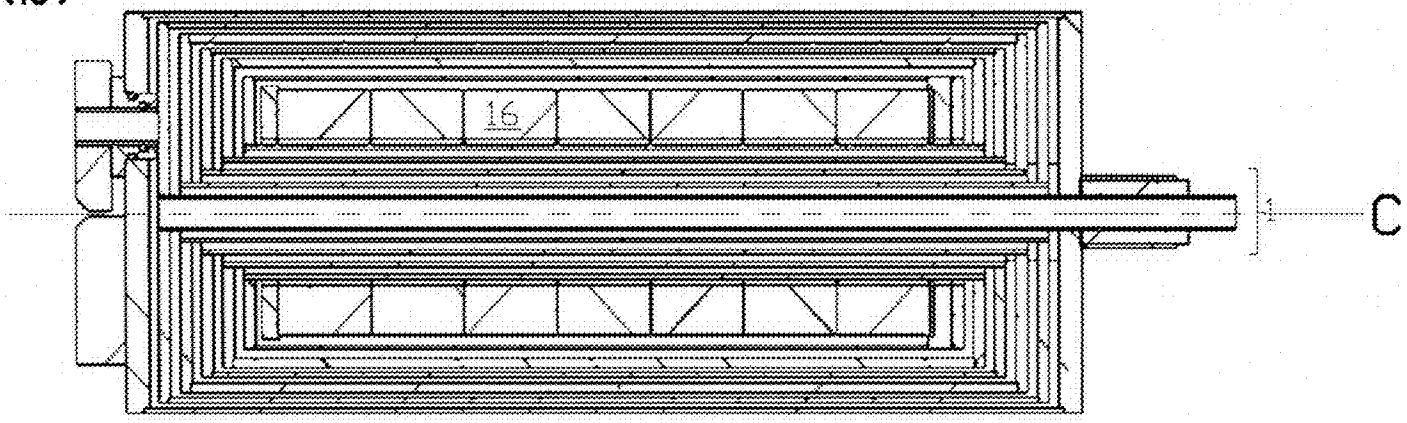

There is shown in the drawings one example of a hand-held fluid-cooled toroidal autotransformer and autotransformer assembly 10 of the present invention.

In this example the outer enclosure of the autotransformer assembly comprises a longitudinally-oriented right circular cylinder 18 and opposing circular end closures 18*a* and 18*b*. In this example of the invention end closure 18*a* includes electric power and cooling fluid supply terminal 1 and electric power and cooling fluid return terminal 2, and end closure 18*b* includes induction work coil circuit electric power and cooling fluid supply terminal 3 and induction work coil circuit electric power and cooling fluid return terminal 4.

In this example of the invention each terminal comprises a hollow electrical conductor with the cooling fluid passage in the hollow interior of the electrical conductor to form a combined electric and cooling fluid terminal. In other examples of the invention the terminals on the outer enclosure can be otherwise configured for connection of electric power and cooling fluid including separate electrical and fluid terminals that are also referred to as connection blocks. In other examples of the invention cooling fluid for the induction work coil circuit is provided separate from an autotransformer of the present invention in a particular application.

The induction work coil circuit is a work induction coil for a particular application, for example, a welding or soldering induction coil, and if required, complementary induction work coil circuit components for a particular application.

In the hand-held fluid-cooled toroidal autotransformer and autotransformer assembly 10 of the present invention shown in the drawings there are a total of eleven (11) longitudinally-oriented, electrically conductive concentric pipes radially spaced apart from each other by twelve (12) concentric cooling liquid passages around toroidal magnetic coil 16. The spaced apart concentric pipes are shown as crosshatched regions in the figures and are designated in FIG. 5 from the radially furthest pipe 14*a* to the radially closest pipe 14*k* to the axis of symmetry C of toroidal core 16 as pipes 14*a* to 14*f*. In this example of the invention radially outer pipes 14*a* to 14*f* surround the entire longitudinally-oriented toroidal magnetic core while radially inner pipes 14*g* to 14*k* are within the interior axial opening of the toroidal core. All of the longitudinally-oriented electrically conductive concentric pipes are physically and electrically configured at their opposing longitudinal ends in series connections to form a fluid-cooled autotransformer of the present invention. In other examples of the invention other quantities of longitudinally-oriented electrically conductive pipes are used and can be arranged in alternative configurations for magnetic coupling with the toroidal magnetic core.

Figure 5:
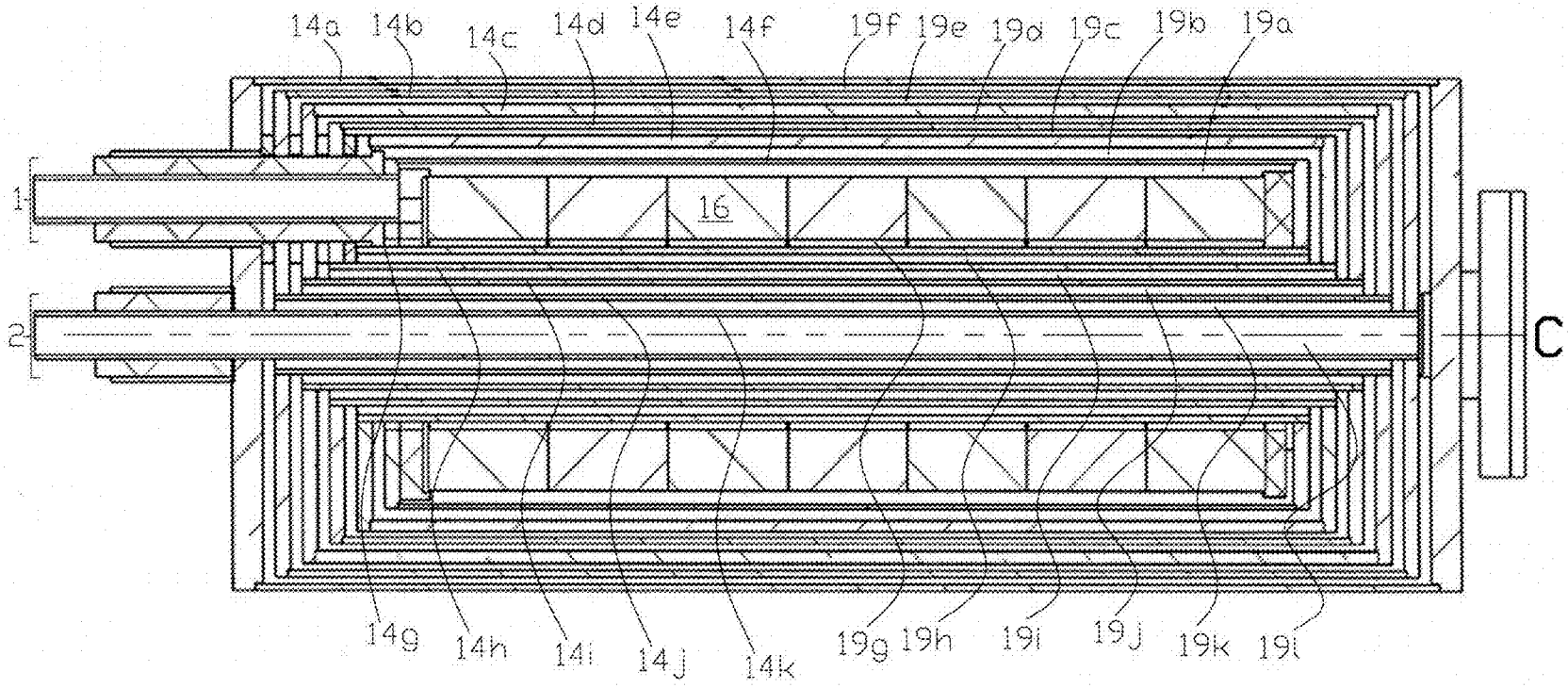
FIG. 5 is a side center cross sectional elevation view of one example of a hand-held fluid-cooled toroidal autotransformer assembly of the present invention illustrating a plurality of longitudinally-oriented, electrically conductive concentric pipes radially spaced apart from each other to form serially connected fluid cooling passages with the concentric pipes connected physically and electrical in series around a toroidal core to form the windings of an autotransformer.

In the figures the longitudinally-oriented concentric cooling liquid passages between the electrically conductive are shown as non-crosshatched regions and are respectively designated in FIG. 5 from the radially furthest cooling passage 19*f* to the radially closest cooling passage 191 to the axis of symmetry C of the toroidal core as sequential elements 19*f*, 19*e*, 19*d*, 19*c*, 19*b*, 19*a*, 19*g*, 19*h*, 19*i*, 19*j*, 19*k* and 19*l*. In this example of the invention radially outer cooling liquid passages 19*f*, 19*e*, 19*d*, 19*c*, 19*b* and 19*a* surround the entire toroidal core while radially inner cooling liquid passages 19*g*, 19*h*, 19*i*, 19*j*, 19*k* and 19*l* are within the interior axial opening of the magnetic toroidal core. The quantities of longitudinally-oriented cooling liquid passages and arrangement thereof will vary according to the quantities and arrangement of longitudinally-oriented electrically conductive pipes utilized in a particular application of the invention. All of the longitudinally-oriented cooling passages are physically configured at their opposing longitudinal ends in series connections to form a fluid-cooled autotransformer of the present invention. With this arrangement of alternating longitudinally-oriented, spaced apart, electrically conductive concentric pipes and cooling liquid passages around toroidal magnetic core 16 a highly uniform cooling of the electrically conductive pipes forming the autotransformer's windings, the toroidal magnetic core and terminals (connection blocks) is achieved.

Figure 6A:
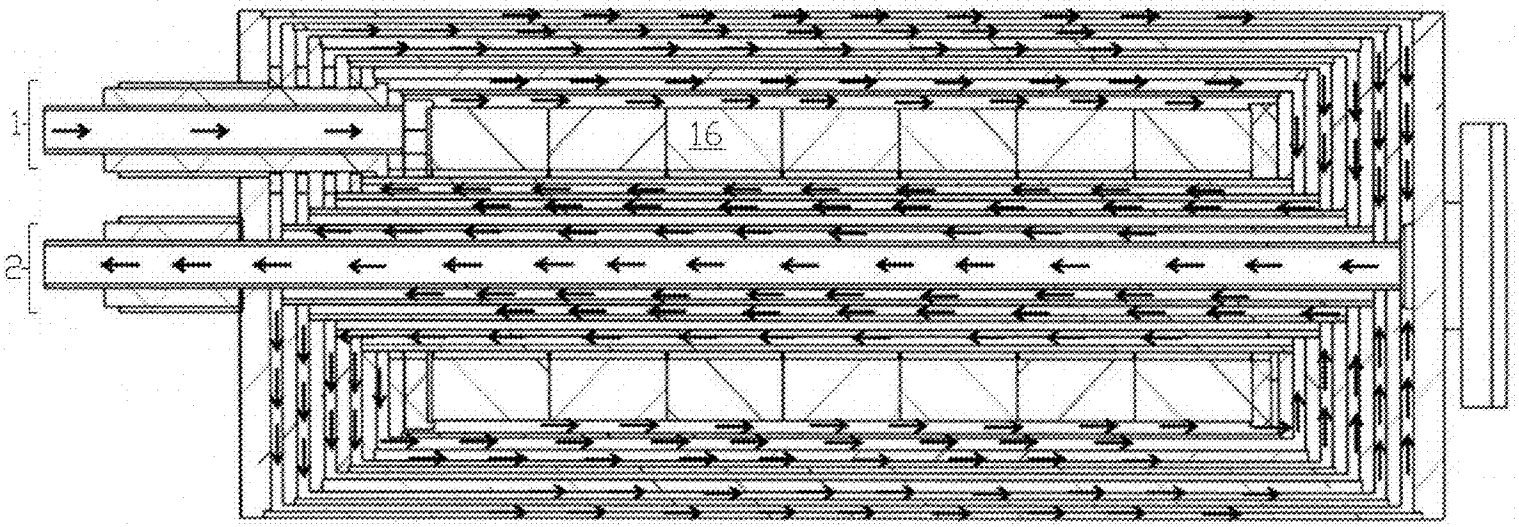
FIG. 6(*a*) is the side center cross sectional elevation view in FIG. 5 illustrating with arrows the cooling fluid flow path around each of the turns in the autotransformer's windings, the toroidal magnetic core and the terminals of the autotransformer assembly.
Figure 6B:
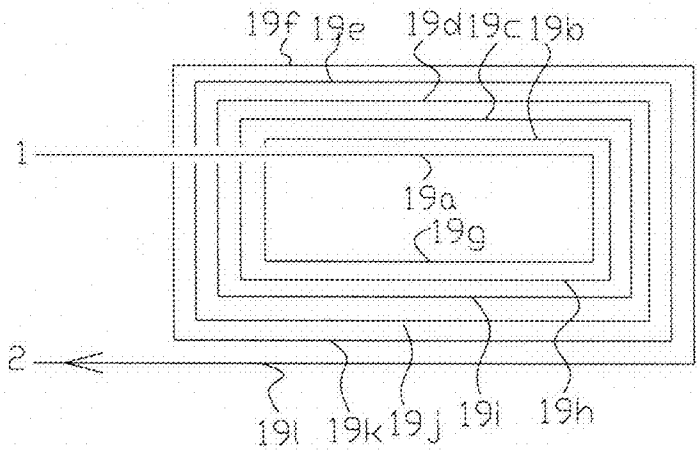

FIG. 6(*a*) and FIG. 6(*b*) illustrate one example of the present invention where the series connected longitudinally-oriented concentric cooling liquid passages are interconnected at their opposing longitudinal ends in series flow to provide autotransformer cooling in a radially inward to outward series spiral loop cooling liquid flow from cooling fluid supply terminal 1 to cooling fluid return terminal 2 through the series connected longitudinally-oriented cooling liquid passages as designated in FIG. 5. This cooling fluid flow arrangement provides the coolest temperature of the supplied cooling fluid adjacent to the toroidal magnetic core.

Figure 7A:
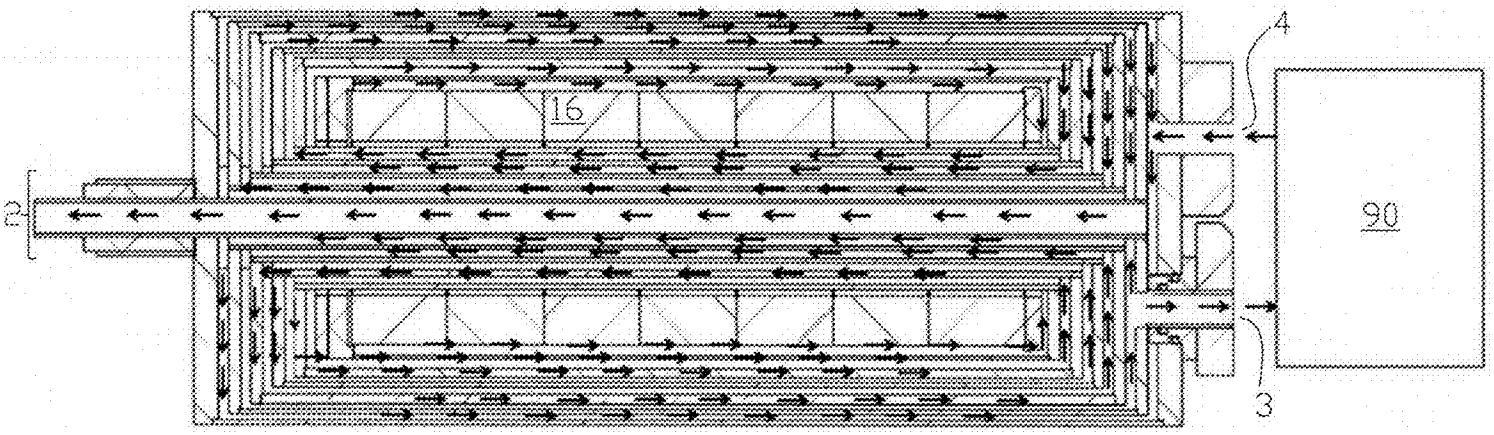
FIG. 7(*a*) is a bottom center cross sectional plan view of one example of a autotransformer assembly of the present invention illustrating with arrows the cooling fluid flow around each of the turns in the autotransformer's windings, the toroidal magnetic core and the terminals of the autotransformer assembly when cooling fluid is provided via the autotransformer assembly to an induction load coil circuit.
Figure 7B:
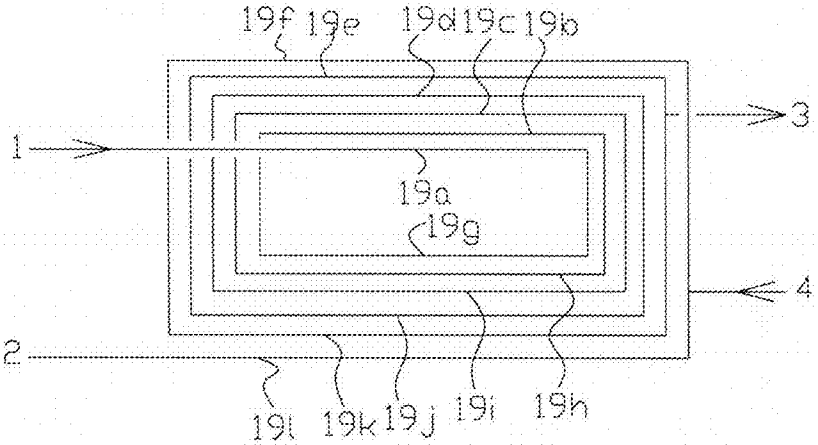

FIG. 7(*a*) and FIG. 7(*b*) illustrate one example of the present invention further supplying cooling fluid to induction work coil circuit 90 from the autotransformer series connected longitudinally-oriented concentric cooling passages circuit in FIG. 6(*a*) and FIG. 6(*b*). In this example, where FIG. 7(*a*) is a bottom center cross sectional plan view of the autotransformer assembly, supply of cooling liquid to terminal 3 of the autotransformer connected to induction work coil circuit 90 is provided between series interconnected longitudinal-oriented concentric cooling liquid passages 19*e* and 19*k* while return of the cooling liquid to terminal 4 of the autotransformer from the induction work coil circuit 90 is provided between series interconnected longitudinally-oriented concentric cooling liquid passages 19*f* and 19*l*. In this optional embodiment of the invention the flow of cooling fluid within the hand-held autotransformer assembly is shared and canalized to the induction work coil circuit 90 as shown in FIG. 7(*a*) and FIG. 7(*b*) by the cooling liquid flow arrows in the cooling fluid flow path from entry into the autotransformer at terminal 1 and exit from the transformer at terminal 2 where the induction work coil circuit supply and return of the cooling fluid is connected at terminals 3 and 4, respectively, to eliminate two additional cooling fluid connection leads with separate cooling fluid supply and return to the induction work coil circuit as may be required in a conventional hand-held transformer assembly.

Figure 8A:
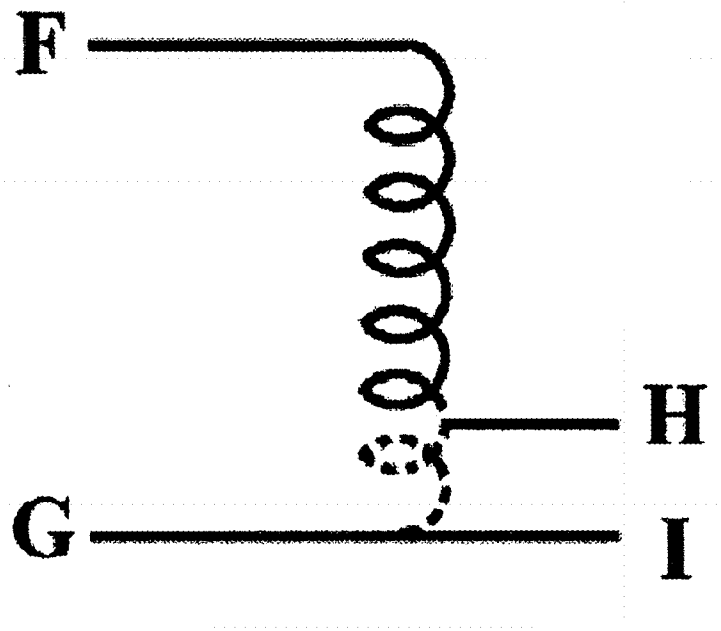
FIG. 8(*a*) illustrates diagrammatically one example of an autotransformer connection implemented in the autotransformer assembly of the present invention shown in the drawings with the autotransformer taps illustrated in FIG. 8(*b*) of the hand-held autotransformer assembly.
Figure 8B:
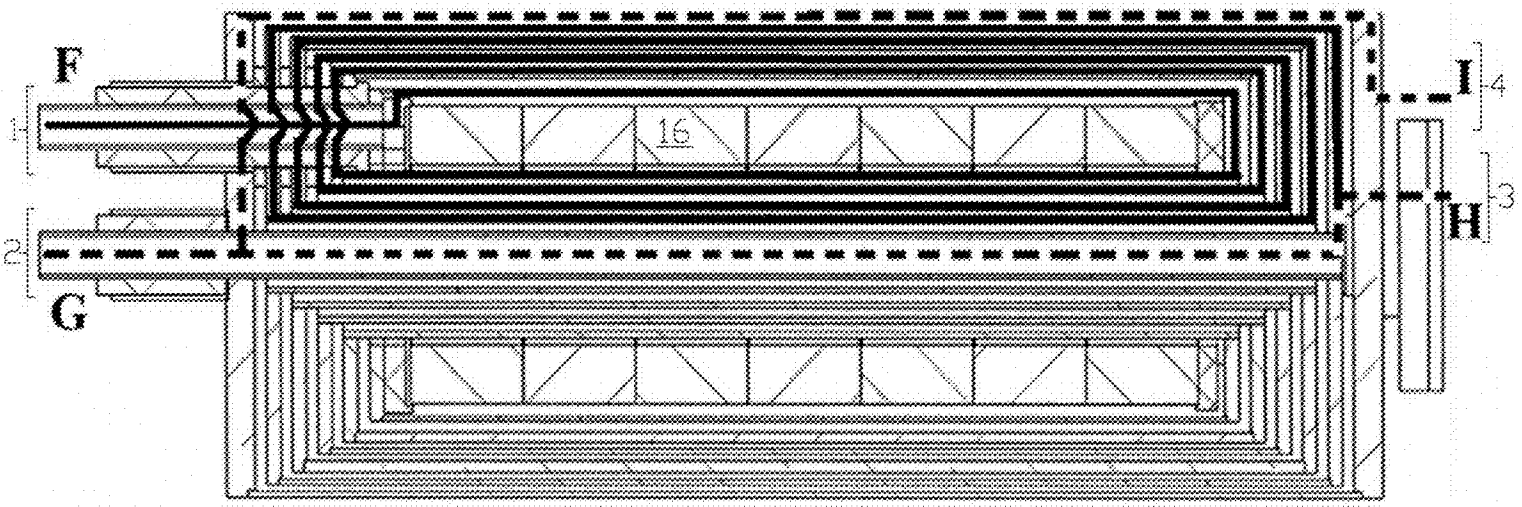
Figure 8C:
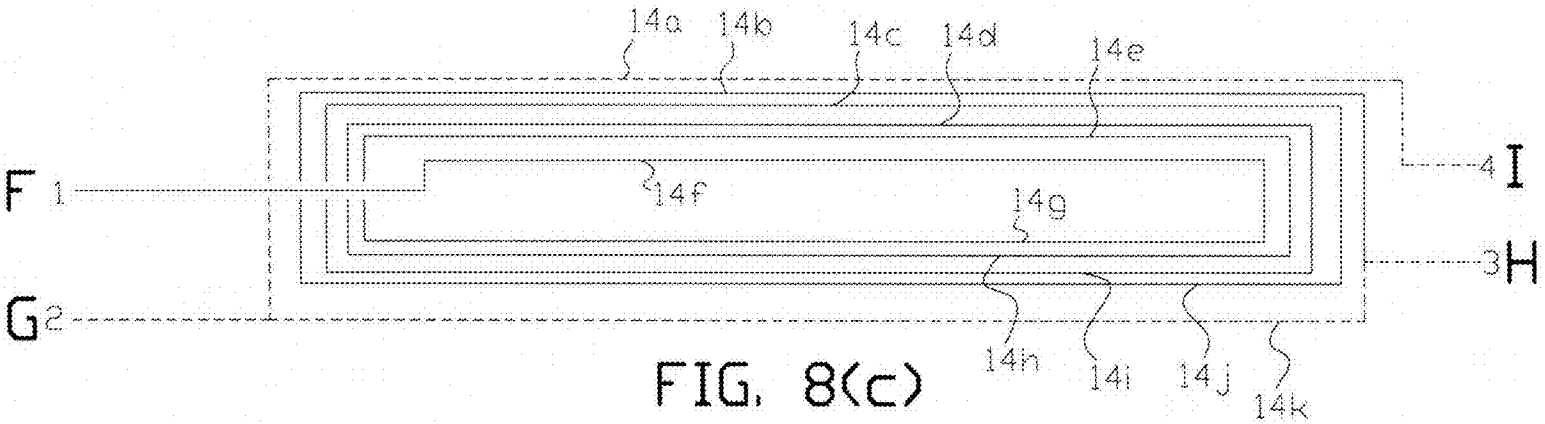

FIG. 8(*b*) and FIG. 8(*c*) illustrate one example of the present invention for forming an autotransformer electrical circuit from the series connected longitudinally-oriented concentric pipes, for example, as diagrammatically illustrated in autotransformer circuit in FIG. 8(*a*). In FIG. 8(*b*) and FIG. 8(*c*) autotransformer input electric power to terminals 1 and 2 forms autotransformer electrical circuit between taps F and G respectively from series connected longitudinally-oriented electrically conductive concentric pipes 14*f*, 14*g*, 14*e*, 14*h*, 14*d*, 14*i*, 14*c*, 14*j*, 14*b* and 14*k*. The autotransformer output electric power to terminals 3 and 4 forms autotransformer electric circuit between taps H and I from series connected longitudinally-oriented electrically conductive concentric pipes 14*k* and 14*a*.

The voltage at autotransformer input terminals 1 and 2 (between circuit points F and G in FIG. 8(*a*) and FIG. 8(*b*) of the hand-held autotransformer, as well as the frequency and the electric current required for the induction work coil circuit 90, determine the capacitance and inductance that is required to achieve suitable electrical performance in a particular application of the present invention.

The array of longitudinally-oriented electrically conductive spaced apart concentric pipes in the present invention increase the intrinsic capacitance of a hand-held fluid-cooled autotransformer of the present invention since the large cylindrical surface areas of the concentric pipes and the cooling liquid flowing between the concentric pipes act like a capacitor array.

Increasing the intrinsic capacitance of the windings in the autotransformer assembly is beneficial in reducing the quantity of external capacitors that are required to tune the input power source connected to autotransformer input terminals 1 and 2 of the hand-held autotransformer assembly of the present invention in a particular application.

In some embodiments of the invention one or more of the sections of the autotransformer circuit formed by the plurality of longitudinally-oriented electrically conductive concentric pipes is replaced with litz wire in serial combination with longitudinally-oriented electrically conductive spaced apart pipes with longitudinally-oriented cooling fluid passages between them for maintaining the water-cooled feature of the autotransformer.

The term electrically conductive pipe as used herein includes hollow electrical conductors and electrically conductive tubing. The pipes, conductors or tubing are formed from an electrically conductive material suitable for a particular application, for example copper or a copper alloy.

The cooling fluid may be any fluid suitable for a particular application, for example, water.

A hand-held toroidal autotransformer assembly of the present invention is capable of providing a thirty percent weight reduction and a twenty percent size reduction in comparison to an equivalent conventional high frequency 300 kVA rated transformer due, in part, to the reduction in the number of electrical and water connection terminals and reduction in the required magnetic core volume of autotransformer assembly 10.

A hand-held toroidal autotransformer assembly of the present invention is capable of providing an increase in the amount of available electric current in a percentage of "100 percent/transformation ratio" at the induction work coil circuit in comparison with a conventional hand-held transformer assembly with an identical transformation ratio.

A hand-held toroidal autotransformer assembly of the present invention is capable of providing a ten percent reduction in electric stress between the inner windings of an autotransformer due to the large surface area achieved by the spaced apart concentric pipes forming the windings of the autotransformer circuit and the electrical connection of the array of spaced apart concentric pipes as shown for an autotransformer represented by the electrical diagram in FIG. 8(*a*).

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention. Those skilled in the art, having the benefit of the teachings of this specification, may make modifications thereto without departing from the scope of the invention.

The invention claimed is:

1. A hand-held fluid-cooled toroidal autotransformer assembly comprising:

an autotransformer enclosure;

a toroidal magnetic core having a longitudinally-oriented axis of symmetry centrally disposed within the autotransformer enclosure;

a plurality of longitudinally-oriented, electrically conductive concentric pipes physically and electrically interconnected in series around the longitudinally-oriented axis of symmetry of the toroidal magnetic core within the autotransformer enclosure to form an autotransformer circuit, the plurality of longitudinally-oriented, electrically conductive concentric pipes radially spaced apart from each other to form a longitudinally-oriented cooling fluid passage between each adjacent concentric pipes of the plurality of longitudinally-oriented, electrically conductive concentric pipes;

a first electric power supply terminal and a second electric power supply terminal disposed on an exterior of the autotransformer enclosure, the first electric power supply terminal and the second electric power supply terminal configured for a source connection of the autotransformer circuit to an alternating current power source;

a first electric load terminal and a second electric load terminal disposed on the exterior of the autotransformer enclosure, the first electric load terminal and the second electric load terminal configured for a work coil connection of the autotransformer circuit to an induction work coil circuit; and a serial autotransformer cooling fluid passage formed from all of the longitudinally-oriented cooling fluid passages connected in series, the serial autotransformer cooling fluid passage having a first passage end and a second passage end, the first passage end comprising a cooling fluid supply terminal disposed on the exterior of the autotransformer enclosure, the cooling fluid supply terminal configured for a fluid supply connection of the serial autotransformer cooling fluid passage to a cooling fluid source, the second passage end comprising a cooling fluid return terminal disposed on the exterior of the autotransformer enclosure, the cooling fluid return terminal configured for a fluid return connection of the serial autotransformer cooling fluid passage to the cooling fluid source.

2. A hand-held fluid-cooled toroidal autotransformer assembly of claim 1, wherein the plurality of longitudinally-oriented, electrically conductive concentric pipes comprises:

a radially outer array of longitudinally-oriented, electrically conductive concentric pipes; and a radially inner array of longitudinally-oriented, electrically conductive concentric pipes, the radially outer array of longitudinally-oriented, electrically conductive concentric pipes disposed radially further away from the longitudinally-oriented axis of symmetry of the toroidal magnetic core than the radially inner array of longitudinally-oriented, electrically conductive concentric pipes.

3. A hand-held fluid-cooled toroidal autotransformer assembly of claim 2, wherein the radially outer array of longitudinally-oriented, electrically conductive concentric pipes are disposed around an outer perimeter of the toroidal magnetic core and the radially inner array of longitudinally-oriented, electrically conductive concentric pipes are disposed within an inner axial opening of the toroidal magnetic core.

4. A hand-held fluid-cooled toroidal autotransformer assembly of claim 3 including at least one litz wire in a series physical and a series electrical connection with the plurality of longitudinally-oriented, electrically conductive concentric pipes.

5. A hand-held fluid-cooled toroidal autotransformer assembly of claim 1, including an induction work coil circuit cooling fluid supply terminal and an induction work coil circuit cooling fluid return terminal, the induction work coil circuit cooling fluid supply terminal and the induction work coil cooling fluid return terminal disposed on the exterior of the autotransformer enclosure, the induction work coil circuit cooling fluid supply terminal and the induction work coil circuit cooling fluid return terminal in fluid communication with the serial autotransformer cooling fluid passage.

6. A hand-held fluid-cooled toroidal autotransformer assembly of claim 1, wherein the cooling fluid supply terminal and the cooling fluid return terminal are configured for a spirally radial inward to a radial outward flow of a cooling fluid in the serial autotransformer cooling fluid passage.

7. A hand-held fluid-cooled toroidal autotransformer assembly of claim 6, including an induction work coil circuit cooling fluid supply terminal and an induction work coil circuit cooling fluid return terminal, the induction work coil circuit cooling fluid supply terminal and the induction work coil circuit cooling fluid return terminal disposed on the exterior of the autotransformer enclosure, the induction work coil circuit cooling fluid supply terminal and the induction work coil circuit cooling fluid return terminal in fluid communication with the serial autotransformer cooling fluid passage.

8. A hand-held fluid-cooled toroidal autotransformer assembly of claim 1, wherein the first electric power supply terminal is combined with the cooling fluid supply terminal and the second electric power supply terminal is combined with the cooling fluid return terminal.

9. A hand-held fluid-cooled toroidal autotransformer assembly of claim 3, including an induction work coil circuit cooling fluid supply terminal and an induction work coil cooling fluid return terminal, the induction work coil circuit cooling fluid supply terminal and the induction work coil cooling fluid return terminal in fluid communication with the serial autotransformer cooling fluid passage.

10. A hand-held fluid-cooled toroidal autotransformer assembly of claim 5, wherein the first electric power terminal is combined with the cooling fluid supply terminal; the second electric power terminal is combined with the cooling fluid return terminal; the first electric load terminal is combined with the induction work coil circuit cooling fluid supply terminal; and the second electric load terminal is combined with the induction work coil circuit cooling fluid return terminal.

11. A method of forming a hand-held fluid-cooled toroidal autotransformer assembly, the method comprising:

arranging a plurality of radially spaced apart longitudinally-oriented, electrically conductive concentric pipes around a longitudinally-oriented axis of symmetry of a toroidal magnetic core in an autotransformer enclosure;

physically and electrically interconnecting the plurality of radially spaced apart longitudinally-oriented, electrically conductive concentric pipes in series at the opposing ends of each of the plurality of radially spaced apart longitudinally-oriented, electrically conductive concentric pipes to form an autotransformer circuit;

providing a first electric power supply terminal and a second electric power supply on the autotransformer enclosure and connecting the first and the second electric power supply terminals to the autotransformer circuit;

serial interconnecting a longitudinally-oriented cooling fluid passage between each of an adjacent one of the plurality of radially spaced apart longitudinally-oriented, electrically conductive concentric pipes to form a serial autotransformer cooling fluid passage;

providing a cooling fluid supply terminal and a cooling fluid return terminal on the autotransformer enclosure; and connecting the cooling fluid supply terminal to a first end of the serial autotransformer cooling fluid passage and the cooling fluid return terminal to a second end of the serial autotransformer cooling fluid passage.

12. The method according to claim 11 including the step of providing an induction work coil circuit cooling fluid supply terminal and an induction work coil circuit cooling fluid return terminal on the autotransformer enclosure and connecting the induction work coil circuit cooling fluid supply terminal and the induction work coil circuit cooling fluid return terminal to the serial autotransformer cooling fluid passage.

13. A hand-held fluid-cooled toroidal autotransformer assembly comprising:

an autotransformer enclosure;

a toroidal magnetic core having a longitudinally-oriented axis of symmetry centrally disposed within the autotransformer enclosure;

a plurality of longitudinally-oriented, electrically conductive concentric pipes physically and electrically interconnected in series around the longitudinally-oriented axis of symmetry of the toroidal magnetic core within the autotransformer enclosure to form an autotransformer circuit, the plurality of longitudinally-oriented, electrically conductive concentric pipes radially spaced apart from each other to form a longitudinally-oriented cooling fluid passage between each adjacent concentric pipes of the plurality of longitudinally-oriented, electrically conductive concentric pipes, the plurality of longitudinally-oriented, electrically conductive concentric pipes comprising a radially outer array of longitudinally-oriented, electrically conductive concentric pipes and a radially inner array of longitudinally-oriented, electrically conductive concentric pipes, the radially outer array of longitudinally-oriented, electrically conductive concentric pipes disposed radially further away from the longitudinally-oriented axis of symmetry of the toroidal magnetic core than the radially inner array of longitudinally-oriented, electrically conductive concentric pipes, the plurality of the radially outer array of longitudinally-oriented, electrically conductive concentric pipes disposed around the outer perimeter of the toroidal magnetic core and the radially inner array of longitudinally-oriented, electrically conductive concentric pipes disposed within the inner axial opening of the toroidal magnetic core;

a first electric power supply terminal and a second electric power supply terminal disposed on an exterior of the autotransformer enclosure, the first electric power supply terminal and the second electric power supply terminal configured for connection of the autotransformer circuit to an alternating current power source;

a first electric load terminal and a second electric load terminal disposed on the exterior of the autotransformer enclosure, the first electric load terminal and the second electric load terminal configured for connection of the autotransformer circuit to an induction work coil circuit;

a serial autotransformer cooling fluid passage formed from all of the longitudinally-oriented cooling fluid passages connected in series, the serial autotransformer cooling fluid passage having a first end and a second end, the first end comprising a cooling fluid supply terminal disposed on the exterior of the autotransformer enclosure, the cooling fluid supply terminal configured for connection of the serial autotransformer cooling fluid passage to a cooling fluid source, the second end comprising a cooling fluid return terminal disposed on the exterior of the autotransformer enclosure, the cooling fluid return terminal configured for connection of the serial autotransformer cooling fluid passage to the cooling fluid source; and an induction work coil circuit cooling fluid supply terminal and an induction work coil cooling fluid return terminal, the induction work coil circuit cooling fluid supply terminal and the induction work coil cooling fluid return terminal disposed on the exterior of the autotransformer enclosure, the induction work coil circuit cooling fluid supply terminal and the induction work coil cooling fluid return terminal in fluid communication with the serial autotransformer cooling fluid passage.

14. A hand-held fluid-cooled toroidal autotransformer assembly of claim 13, wherein the first electric power terminal is combined with the cooling fluid supply terminal; the second electric power terminal is combined with the cooling fluid return terminal; the first electric load terminal is combined with the induction work coil circuit cooling fluid supply terminal; and the second electric load terminal is combined with the induction work coil circuit cooling fluid return terminal.

15. A hand-held fluid-cooled toroidal autotransformer assembly of claim 14, wherein the cooling fluid supply terminal and the cooling fluid return terminal are configured for a spirally radial inward to radial outward flow of a cooling fluid supply and return to the cooling fluid source in the serial autotransformer cooling fluid passage.

* * * * *